US009731161B2

(12) United States Patent
Meeker

(10) Patent No.: US 9,731,161 B2
(45) Date of Patent: Aug. 15, 2017

(54) SYSTEM FOR LINKING DUMBBELLS TO INCREASE THE WEIGHT LIFTED BY A USER

(71) Applicant: Stephen Meeker, Delaware, OH (US)

(72) Inventor: Stephen Meeker, Delaware, OH (US)

( * ) Notice: Subject to any disclaimer, the term of this patent is extended or adjusted under 35 U.S.C. 154(b) by 0 days.

(21) Appl. No.: 14/940,550

(22) Filed: Nov. 13, 2015

(65) Prior Publication Data

US 2017/0136284 A1 May 18, 2017

(51) Int. Cl.

| | |
|---|---|
| ***A63B 21/072*** | (2006.01) |
| ***A63B 21/075*** | (2006.01) |
| *A63B 21/00* | (2006.01) |
| *A63B 21/06* | (2006.01) |
| *A63B 71/00* | (2006.01) |

(52) U.S. Cl.

CPC ..... *A63B 21/0728* (2013.01); *A63B 21/075* (2013.01); *A63B 21/0726* (2013.01); *A63B 21/00058* (2013.01); *A63B 21/00065* (2013.01); *A63B 21/0605* (2013.01); *A63B 71/0036* (2013.01)

(58) Field of Classification Search

CPC ..... A63B 21/0728; A63B 21/075; A63B 21/0726; A63B 71/0036; A63B 1/00; A63B 1/005; A63B 21/0004; A63B 21/00058; A63B 21/00061; A63B 21/00065; A63B 21/06; A63B 21/0601; A63B 21/0605; A63B 21/07; A63B 21/0722; A63B 21/0724; A63B 23/03508; A63B 23/1281

See application file for complete search history.

(56) References Cited

U.S. PATENT DOCUMENTS

| | | | | |
|---|---|---|---|---|
| 5,630,776 | A * | 5/1997 | Yang | A63B 71/0036 211/198 |
| 7,134,548 | B2 * | 11/2006 | Meehan | A45C 11/00 206/315.1 |
| 7,731,639 | B1 * | 6/2010 | Shifferaw | A63B 21/00181 482/108 |
| 8,684,889 | B1 * | 4/2014 | Berrisford | A63B 21/4035 482/107 |
| 9,017,231 | B2 * | 4/2015 | Kosich | A63B 21/065 482/105 |
| 2009/0258765 | A1 * | 10/2009 | Panicali | A63B 21/4017 482/106 |

(Continued)

OTHER PUBLICATIONS

Common Sheet Metal Gauges: Website: http://www.sheetmetalguy.com/sheet_metal_gauge_chart.htm Archived: Feb. 24, 2011 Retrieved: Nov. 15, 2016.*

*Primary Examiner* — Joshua Lee
*Assistant Examiner* — Megan Anderson
(74) *Attorney, Agent, or Firm* — Standley Law Group LLP

(57) ABSTRACT

The present invention is a device configured to permit combining the weight of a first and second free weight such that a user could grasp one of the weights in order to lift the combined weights. Embodiments of the invention comprise a back panel connected to two side panels, the side panels each comprising a slot with an opening divided into two portions oriented such that a first free weight may be inserted into the slot of each panel and positioned into a first slot portion, followed by a second free weight positioned in the second slot portion of each panel to permit a user to increase the resistance available for an exercise regimen.

10 Claims, 4 Drawing Sheets

(56) References Cited

U.S. PATENT DOCUMENTS

| | | | | |
|---|---|---|---|---|
| 2011/0111929 | A1* | 5/2011 | Allison | A63B 21/072<br>482/108 |
| 2012/0329613 | A1* | 12/2012 | Schiano | A63B 21/078<br>482/94 |
| 2014/0027223 | A1* | 1/2014 | Moore | A45C 13/02<br>190/102 |
| 2014/0135186 | A1* | 5/2014 | Reynolds | A63B 21/0726<br>482/108 |
| 2014/0367351 | A1* | 12/2014 | Juen | A63B 71/0036<br>211/85.7 |

* cited by examiner

SYSTEM FOR LINKING DUMBBELLS TO INCREASE THE WEIGHT LIFTED BY A USER

CROSS-REFERENCE TO RELATED APPLICATION

This application makes no priority claim.

TECHNICAL FIELD

Exemplary embodiments of the present invention relate generally to a device for linking weights used to perform various resistance training exercises in order to increase the resistance available to a user.

BACKGROUND AND SUMMARY OF THE INVENTION

Weights are commonly used in resistance training exercise programs. There are predominantly two types of weights, those incorporated into a machine that controls or limits the user's movements in order to prevent injury and allow the resistance to be applied to a specific muscle group, and weights that are not connected to a machine and thus can be moved freely (Free Weights). This invention is predominantly applicable to free weights. There are various types of free weights available to those that are exercising. Some of these are comprised of various lengths of bar to which weights may be added at each end to achieve the amount of weight desired by a user. These weights are commonly configured with a longer length of bar that a user can grip with both hands in order to perform exercises with both arms. Other types of weights are non-adjustable. A type of non-adjustable weight is commonly called a "dumbbell." Dumbbells are frequently configured with a shorter bar length and lower weight such that a user could grip the dumbbell in one hand. Typical dumbbell weight designs are configured as a fixed size or weight and therefore a disadvantage of dumbbells is that, as a user progresses through their exercise program, the user may find that the dumbbells available to them are not sufficiently heavy to meet the user's increasing weight requirements. Prior to this invention, a user was forced to either be satisfied with a lower weight or purchase new and heavier weights. What is needed is a device for combining the weight of multiple dumbbells in order to allow a user to achieve a greater amount of weight without having to purchase additional weights.

In an embodiment of the invention, a device may comprise a pair of slots into which a first and second weight may be positioned. Such slots may permit a user to insert a first dumbbell and a second dumbbell into the device. Once the first and second dumbbells are inserted into the slots, a user may grip the handle of one of the dumbbells and lift the combined dumbbells using the invention to link the dumbbells together. The invention causes the first dumbbell to lift the device and the second dumbbell, thus increasing the weight lifted by a user. Embodiments of the invention may be formed from a single pieced of steel or other rigid material or may be formed by the combination of a plurality of pieces that may be fastened together to form a device with slots to hold a first and second dumbbell. In certain embodiments of the invention, openings may be formed in the device to allow a user to secure one of the dumbbells used to prevent that dumbbell from moving in the device and injuring the user.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Figure 1:
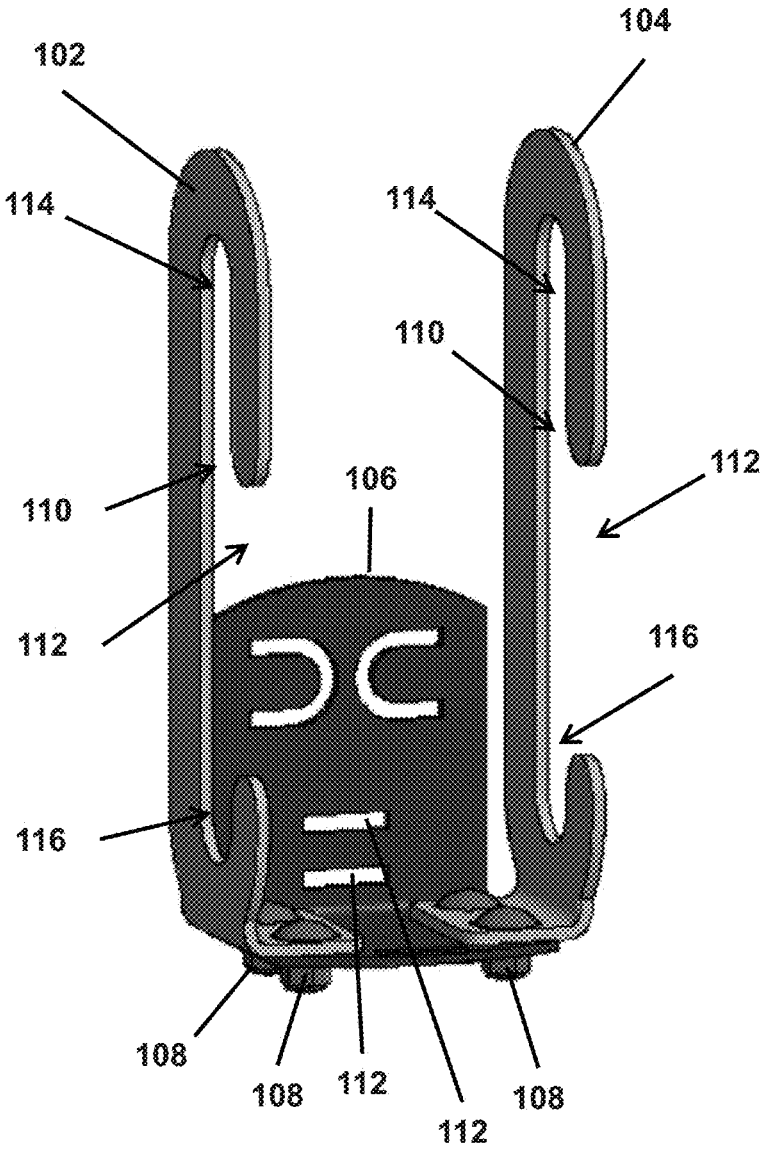
FIG. 1 is a perspective view of the invention shown without dumbbells installed.

Referring to FIG. 1, an embodiment of the invention is illustrated that is formed from a left panel 102, a right panel 104, and a connector panel 106. As is illustrated, the connector panel may be affixed to the left 102 and right 104 panels using a plurality of fasteners 108. As illustrated, this may be nuts and bolts, but also may be other fasteners, including, but not limited to, rivets and welds. Additionally, embodiments of the invention may be formed from a single sheet of rigid material cut and formed to approximate what is illustrated in FIG. 1.

Figure 2:
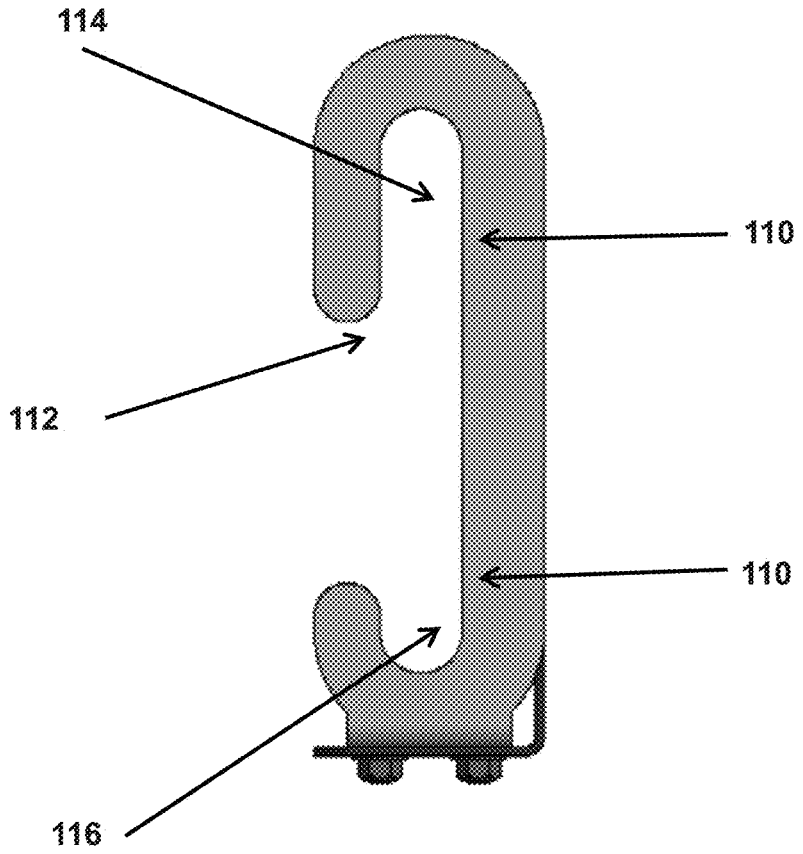
FIG. 2 is a side view of an embodiment of the invention illustrating a side panel.
Figure 3:
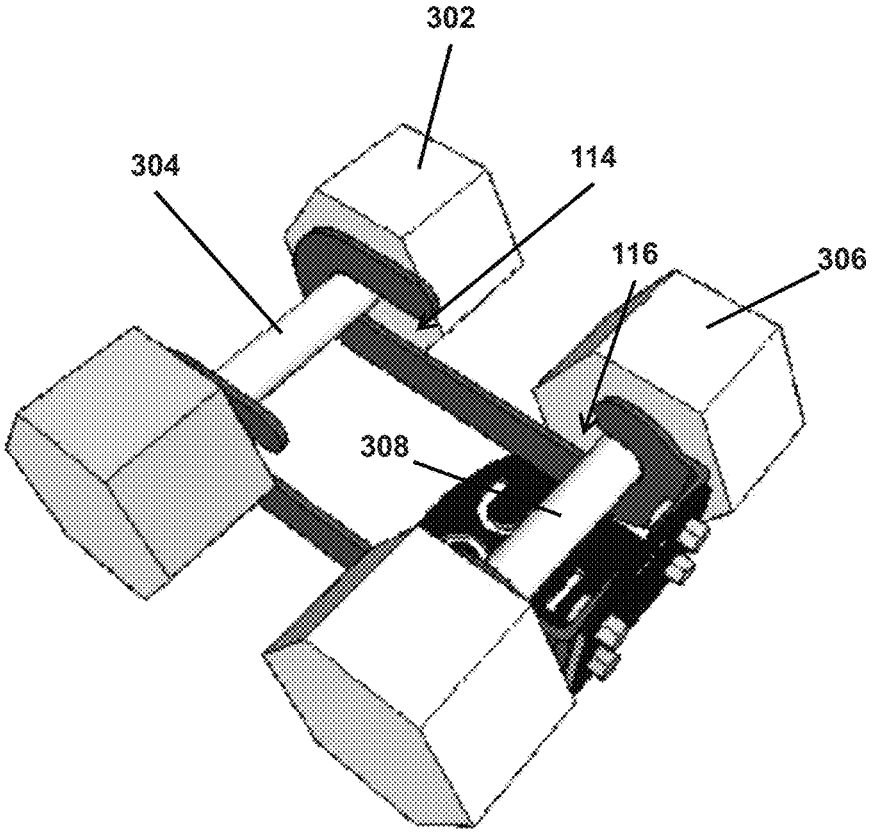
FIG. 3 is an orthogonal view of an embodiment of invention showing two dumbbells installed.

As illustrated, the left 102 and right 104 panels comprise a slot 110 that extends from a point near the top of the side panel to near the bottom of the side panel. The slot 110 comprises an opening 112 and an upper 114 and lower 116 hook structure. FIG. 2 illustrates a side view of an exemplary side panel. As shown, a slot 110 may extend from the opening 112 upward to an upper hook 114 and downward to a lower hook 116. As illustrated in FIG. 3, a first weight 302 may be installed in an embodiment of the invention such that the handle 304 of the weight is located in an upper hook structure 114 of each side panel. As shown, the handle 304 is located in the slot 110 and retained in the slot by the front portion of the upper hook 114. Once a first weight is installed in an embodiment of the invention, a second weight 306 may be inserted into the invention such that the handle 308 of the second weight 306 is captured by the lower hook structure 116.

Figure 4:
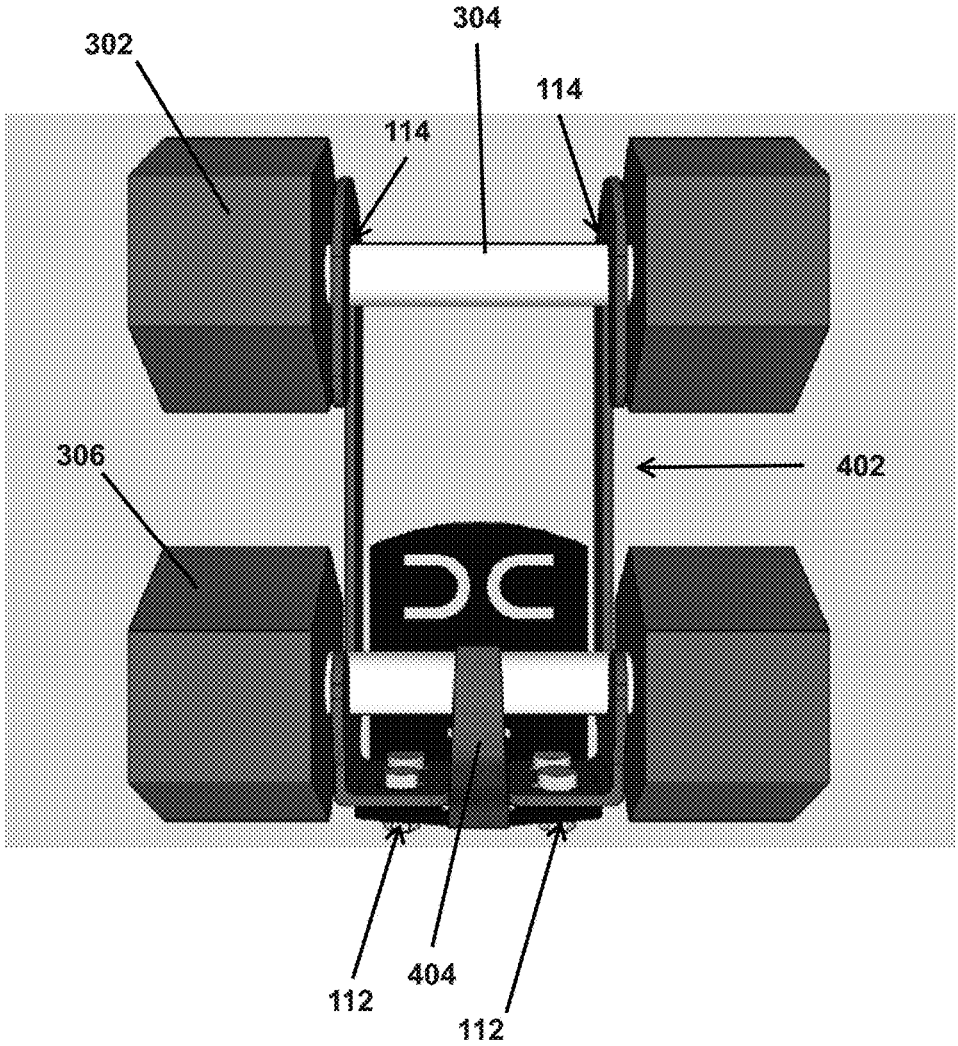
FIG. 4 is a front view of an embodiment of the invention showing two dumbbells installed with a safety strap.

As illustrated in FIG. 4, the first weight 302 and second weight 306 are captured by the upper and lower hooks. A user may grasp the handle 304 of the first weight and lift the first weight 302, the second weight 306, and the invention 402. As a result, the user will be lifting the combined weight of both weights and the invention. Thus, the invention may allow a user to combine dumbbell weights such that the user may not be required to purchase or own dumbbells that, standing alone, have the combined weight of the first and second weights as illustrated in FIG. 4.

In certain embodiments of the invention, an opening may be provided for a strap 404 to secure the second weight 306 into an embodiment of the invention. Such an opening is illustrated in FIG. 1 at 112. In addition to the openings shown, other openings may be formed in various other portions of the connector panel 106. In such an embodiment of the invention, a strap 404 may be inserted into the opening and wrapped around the handle 308 of the second weight 306 to secure it in place. As secured, the weight is less likely to slide along the slot 110 where it could make contact with the first weight 302. The use of such a strap 404, while not necessary, may reduce the likelihood of a user being pinched or otherwise injured by a weight shifting in an embodiment of the invention. In other embodiments of the invention, a ring or other method of securing a strap may be affixed to a portion of the invention.

In order to use an embodiment of the invention, a user may place the handle portion 304 of a first dumbbell 302 into the opening 112 between the upper and lower hook structure. The user may then move the handle along the slot 110 until the handle reaches an end of the slot. In the illustrated embodiment the user is required to move the first dumbbell to the upper hook 114 in order to provide access for a second weight. The user may then place a second dumbbell 306 into the opening 112 and move that dumbbell the opposite direction of the first dumbbell to the lower hook 116. When the second dumbbell is in place in the lower hook, a user may grasp the handle 304 of the first dumbbell 302 in a manner similar to how the handle would be grasped if the first dumbbell were not installed in the invention. When the user grasps the handle 304 and lifts, the invention will cause the upper hook to catch on the handle 304 of the dumbbell being lifted and cause the second dumbbell 306 to be raised as well. Thus, the user is raising both the first and second dumbbells, effectively combining their weights. If the user is using a strap 404 to secure the dumbbell, the user may wrap the strap around the second dumbbell handle portion 308 prior to lifting the combined weights.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A device for combining the weight of a first and second free weight comprising:

a first side panel comprising a first slot formed along a length of said panel;

a second side panel comprising a second slot formed along the length of said second panel and substantially parallel with said first slot;

a back panel which is connected to said first and second side panels such that the first and second said panels are positioned substantially parallel with each other and substantially perpendicular with said back panel;

an opening formed in each of the first side panel and the second side panel that allows for the insertion of a dumbbell handle into said first and second slots, wherein each of said first and second slots comprises a first portion and a second portion, wherein said opening in each side panel divides the respective slot into the respective first portion and the respective second portion, wherein each of the first and second portions are configured to receive a dumbbell handle.

2. The device of claim 1, wherein said first side panel, said second side panel, and said back panel are formed of a rigid material.

3. The device of claim 2, wherein said first side panel, said second side panel, and said back panel are formed from a single piece of rigid material.

4. The device of claim 2, where said rigid material comprises 7 gauge or 10 gauge steel.

5. The device of claim 1, wherein the first and second side panels and the back panel are discrete pieces of material affixed together using a plurality of fasteners.

6. The device of claim 5, wherein said fasteners are nuts and bolts.

7. The device of claim 1, further comprising an opening formed at said back panel adapted to allow a strap to be looped around a dumbbell handle of a second dumbbell, securing said handle to said back panel.

8. The device of claim 7, wherein said opening formed at said back panel is a slot formed in said back panel.

9. The device of claim 1, wherein said first and second side panels comprise a length and width where said length is longer than said width.

10. A device for combining the weight of a first and second free weight comprising:

a first slot formed in a first side panel;

a second slot formed in a second side panel that is oriented substantially parallel to a first side panel;

said first and second slot each comprising an opening formed along a portion of one wall of each said first and second slots;

a first hook structure formed at a first end of each said first and second slots;

a second hook structure formed at a second end of each of said first and second slots;

a connection portion which connects said first and second side panels together, said connection portion secured to said first and second side panels with a plurality of nut and bolt fasteners; and wherein said connection portion comprises a plurality of slots which are configured such that a strap may be inserted into at least one slot of said plurality of slots and be wrapped around a handle of a weight device positioned in the second hook structure.

* * * * *